US011827051B2

(12) United States Patent
Wrobel

(10) Patent No.: US 11,827,051 B2
(45) Date of Patent: Nov. 28, 2023

(54) CANVAS FRAME

(71) Applicant: Antony James Wrobel, South St. Paul, MN (US)

(72) Inventor: Antony James Wrobel, South St. Paul, MN (US)

( * ) Notice: Subject to any disclaimer, the term of this patent is extended or adjusted under 35 U.S.C. 154(b) by 370 days.

(21) Appl. No.: 17/190,610

(22) Filed: Mar. 3, 2021

(65) Prior Publication Data

US 2022/0281264 A1 Sep. 8, 2022

(51) Int. Cl.
*B44D 3/18* (2006.01)

(52) U.S. Cl.
CPC ..... *B44D 3/185* (2013.01)

(58) Field of Classification Search
CPC . B44D 3/18; B44D 3/185; D06C 3/00; D06C 3/08; D05C 1/00; D05C 1/02
See application file for complete search history.

(56) References Cited

U.S. PATENT DOCUMENTS 739,112 A * 9/1903 Santemma ..... A47G 1/0644 40/790
1,523,397 A * 1/1925 Cane ..... D05C 1/02 38/102.6
1,895,309 A * 1/1933 Boomershine ..... D06C 3/04 209/403
2,003,531 A * 6/1935 Galante ..... C14B 1/26 428/581
2,197,287 A * 4/1940 Almendinger ..... C14B 1/26 451/236
3,321,885 A * 5/1967 Pratt ..... A47G 1/0605 160/381
4,065,334 A * 12/1977 Clay ..... C14B 1/56 156/68
4,811,576 A * 3/1989 Davis ..... C14B 1/58 69/19.2
5,133,140 A * 7/1992 Frey ..... B44C 7/022 160/398
5,819,654 A * 10/1998 Farr ..... B41F 15/36 101/127
5,900,276 A 5/1999 Sooklaris
2006/0010729 A1 1/2006 Liu

* cited by examiner

*Primary Examiner* — Ismael Izaguirre
(74) *Attorney, Agent, or Firm* — Brian D. Kaul; Westman, Champlin & Koehler, P.A.

(57) ABSTRACT

A canvas frame includes an outer frame, a shoulder portion and a canvas. The outer frame includes a front surface facing a front side, a back surface facing a back side, and an interior wall extending between the front and back surfaces and surrounding an interior. The shoulder portion extends from the interior wall into the interior and includes a front surface facing the front side that is recessed from the front surface of the outer frame. The canvas is stretched across the interior and attached to the front surface of the shoulder portion using a plurality of fasteners. Each fastener has an exposed portion. A peripheral edge portion of the canvas includes scalloped portions between adjacent fasteners where the canvas sags toward the interior due to tension in the canvas between opposing fasteners.

24 Claims, 14 Drawing Sheets

CANVAS FRAME

FIELD

Embodiments of the present disclosure relate to a canvas frame having a canvas, and a method of manufacturing the canvas frame.

BACKGROUND

Painters use canvas frames to support a canvas while painting. Conventional canvas frames place the canvas over a front surface of a frame, roll the peripheral edges of the canvas over the edges of the frame, and secure the peripheral edges to the sides of the frame or to a back surface of the frame using nails, tacks, staples, or other suitable fasteners. A primer is applied to the front surface of the canvas to generally prepare the canvas to receive a painted image.

SUMMARY

Embodiments of the present disclosure are directed to canvas frames and a method of manufacturing a canvas frame. One embodiment of the canvas frame includes an outer frame, a shoulder portion and a canvas. The outer frame includes a front surface facing a front side, a back surface facing a back side, and an interior wall extending between the front and back surfaces and surrounding an interior. The shoulder portion extends from the interior wall into the interior and includes a front surface facing the front side that is recessed from the front surface of the outer frame. The canvas is stretched across the interior and attached to the front surface of the shoulder portion using a plurality of fasteners. Each fastener has an exposed portion. A peripheral edge portion of the canvas includes scalloped portions between adjacent fasteners where the canvas sags toward the interior due to tension in the canvas between opposing fasteners.

Another embodiment of the canvas frame includes an outer frame and a canvas. The outer frame includes a front surface facing a front side, a back surface facing a back side, and an interior wall extending between the front and back surfaces and surrounding an interior. The canvas is stretched across the interior and attached to the front surface of the outer frame using a plurality of fasteners. Each fastener has an exposed portion. A peripheral edge portion of the canvas includes scalloped portions between adjacent fasteners where the canvas sags toward the interior due to tension in the canvas between opposing fasteners.

In one embodiment of the method of manufacturing a canvas frame, an outer frame is provided that includes a front surface facing a front side, a back surface facing a back side, and an interior wall extending between the front and back surfaces and surrounding an interior. A shoulder portion is provided that extends from the interior wall into the interior and including a front surface facing the front side that is recessed from the front surface of the outer frame. A canvas is attached to the front surface of the shoulder portion using a plurality of fasteners. Each fastener has an exposed portion that is visible from a front side of the canvas. A peripheral edge portion of the canvas includes scalloped portions between adjacent fasteners where the canvas sags toward the interior due to tension in the canvas.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

Figure 1:
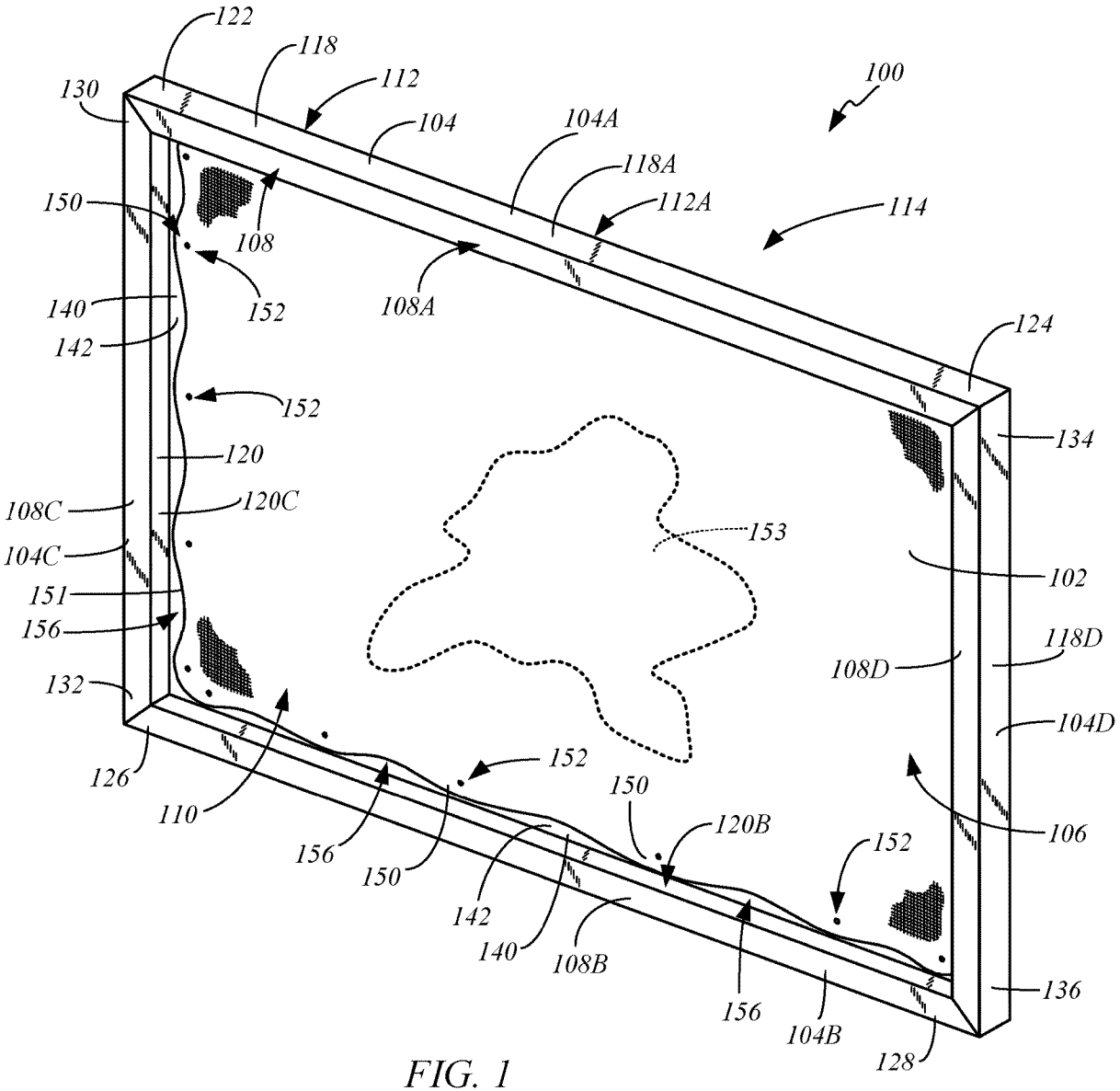
FIG. 1 is a front isometric view of a canvas frame, in accordance with embodiments of the present disclosure.

Some of the drawings may include marks illustrating surface shading or texture of various surfaces and/or materials. Such marks do not represent a marking or ornamental feature of the illustrated objects.

DETAILED DESCRIPTION OF ILLUSTRATIVE EMBODIMENTS

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Figure 2:
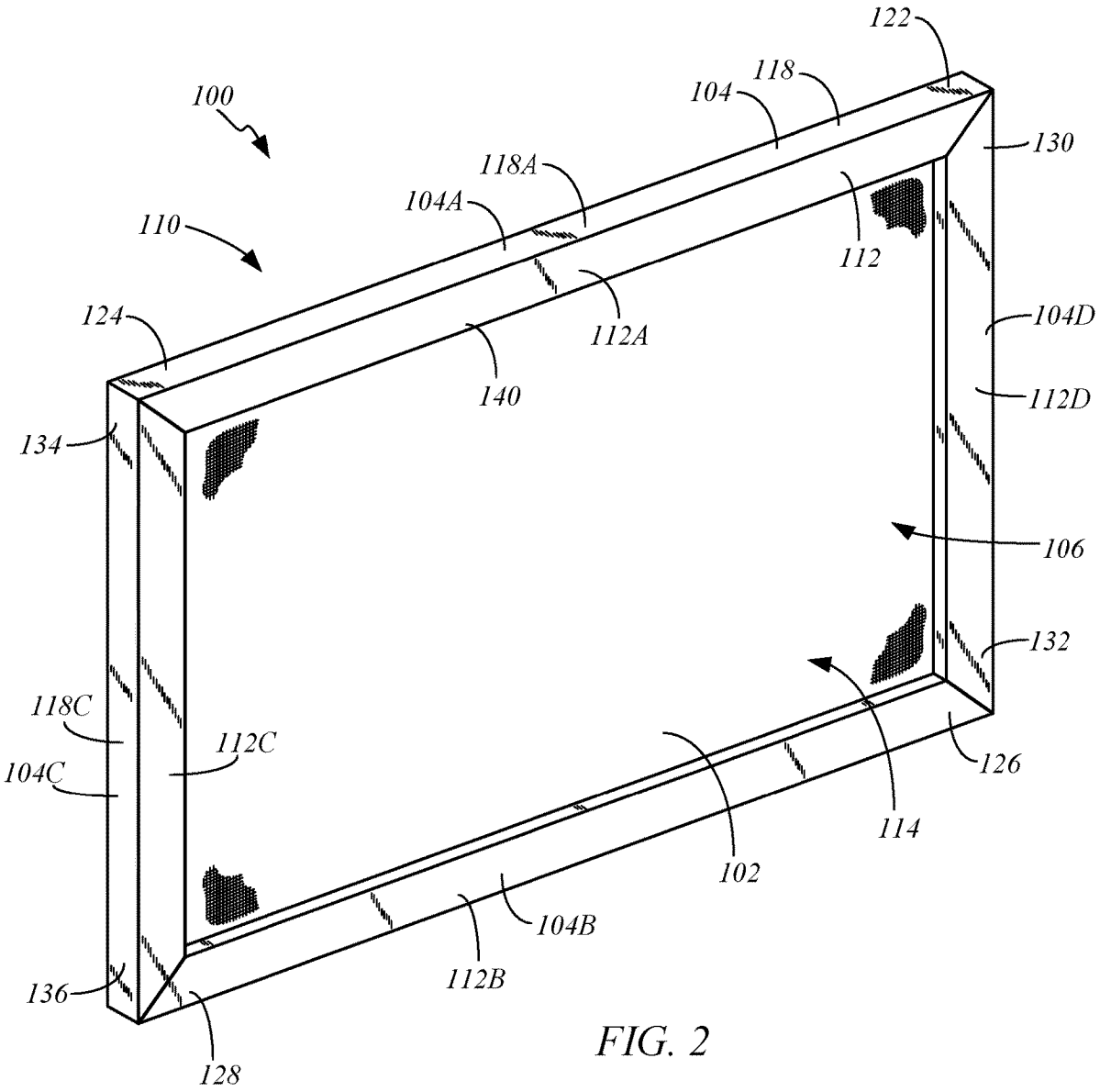
FIG. 2 is a rear isometric view of the canvas frame of FIG. 1, in accordance with embodiments of the present disclosure.
Figure 3:
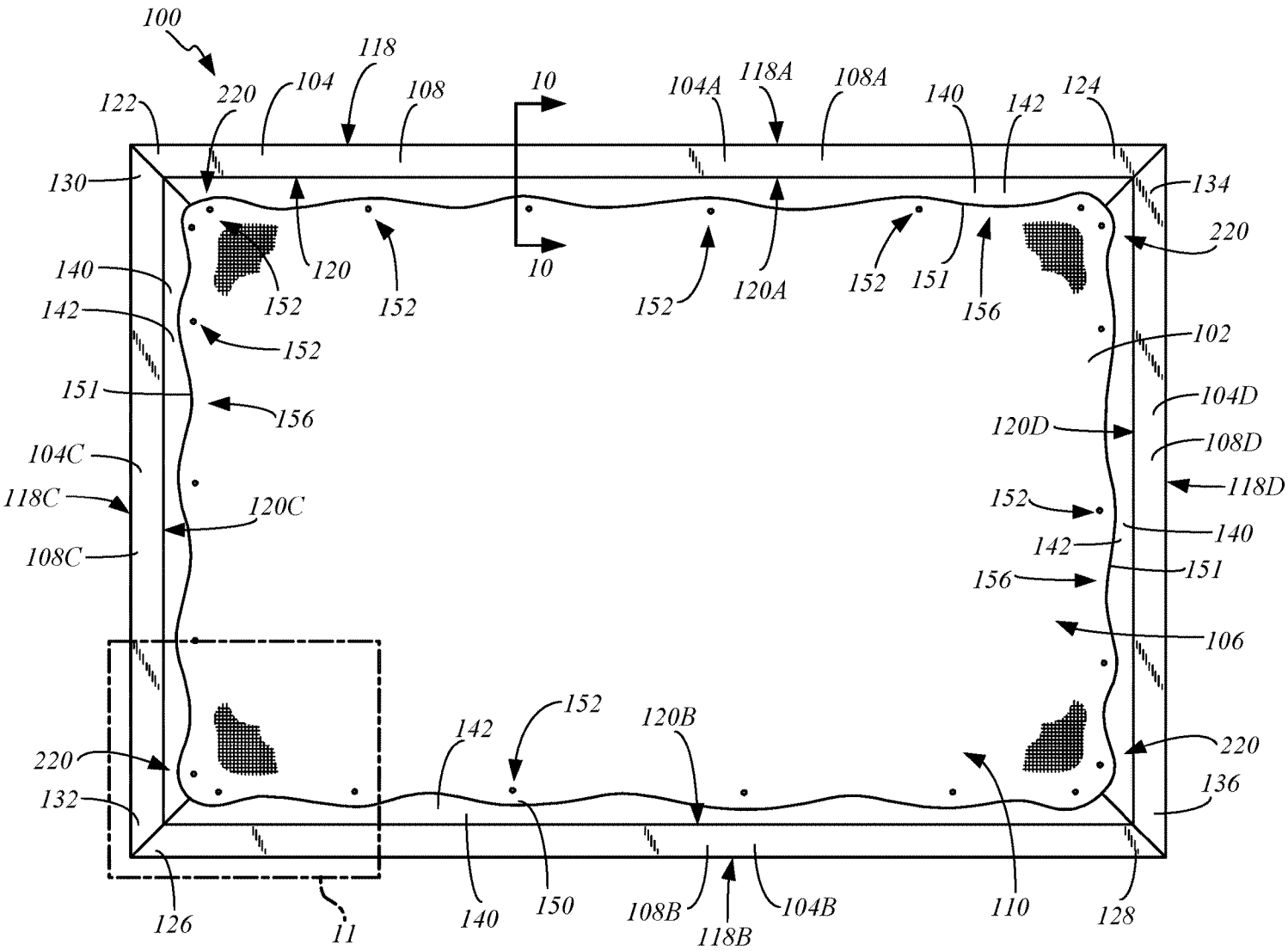
FIG. 3 is a front view of the canvas frame of FIG. 1, in accordance with embodiments of the present disclosure.
Figure 4:
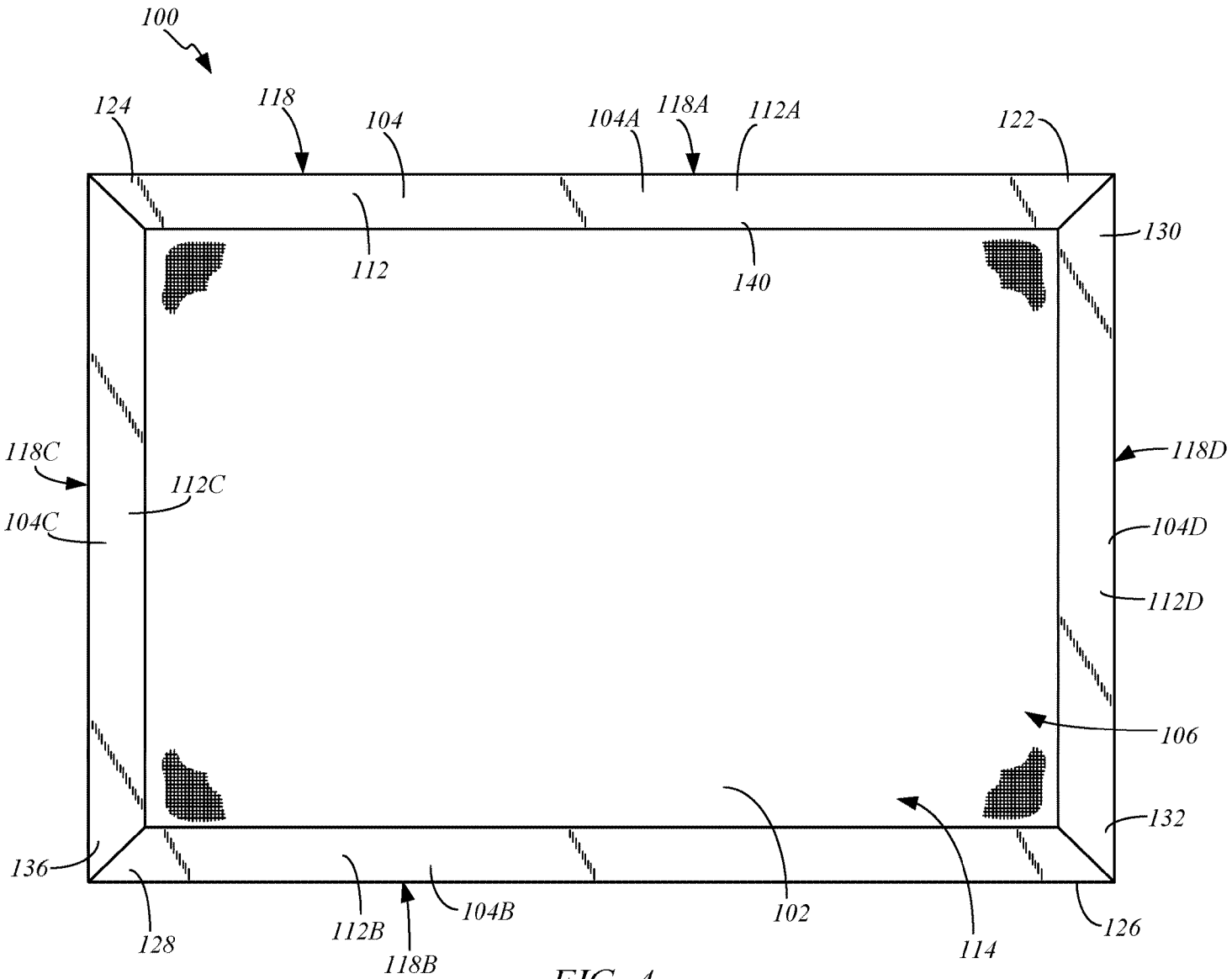
FIG. 4 is a rear view of the canvas frame of FIG. 1, in accordance with embodiments of the present disclosure.
Figure 5:
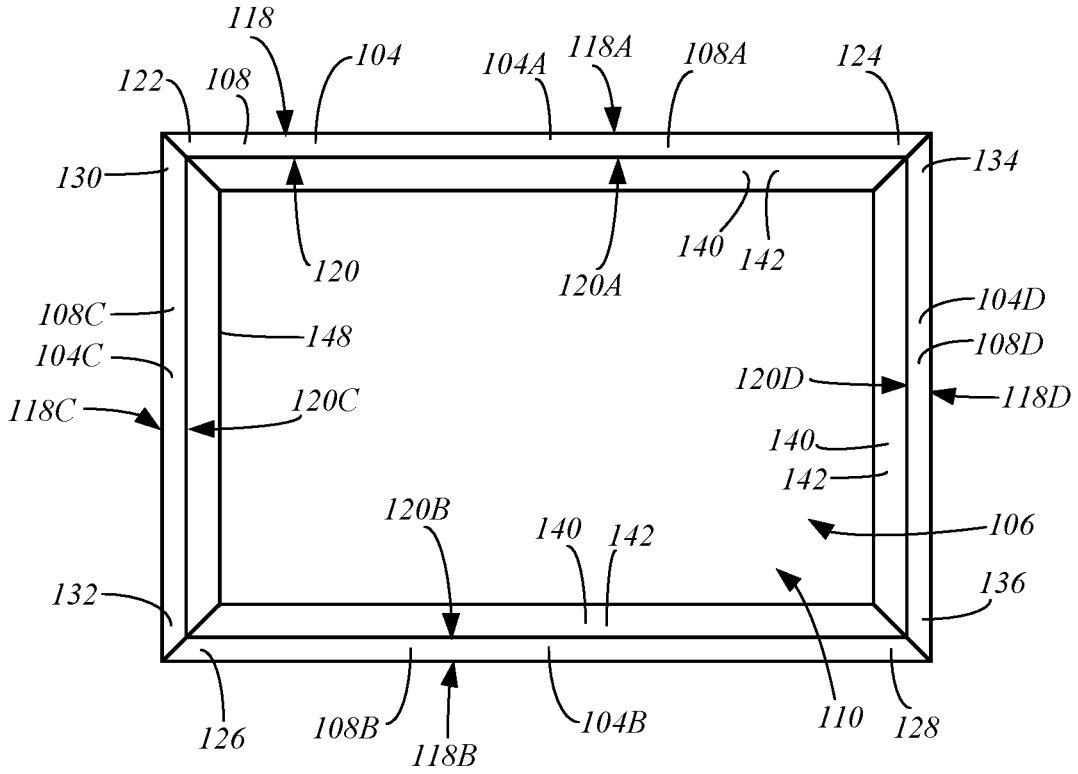
FIG. 5 is a front view of the canvas frame of FIG. 1 without the canvas, in accordance with embodiments of the present disclosure.
Figure 6:
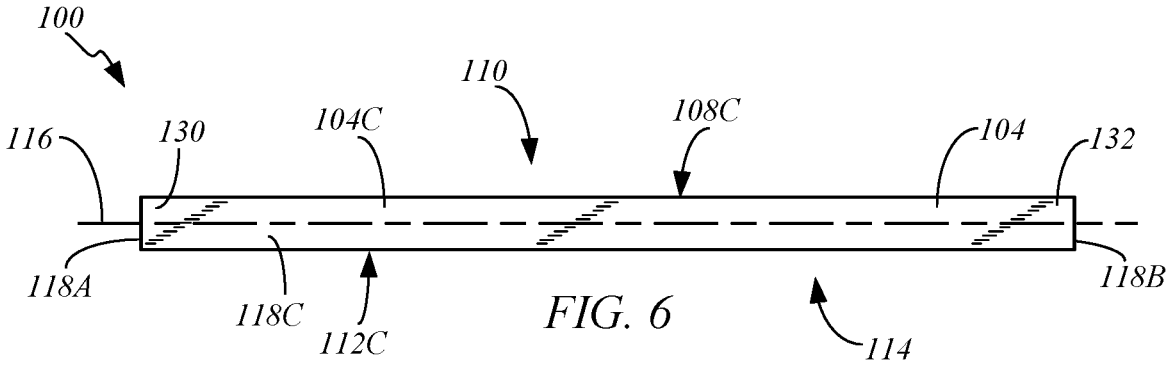
FIG. 6 is a left side view of the canvas frame of FIG. 1, in accordance with embodiments of the present disclosure.
Figure 7:
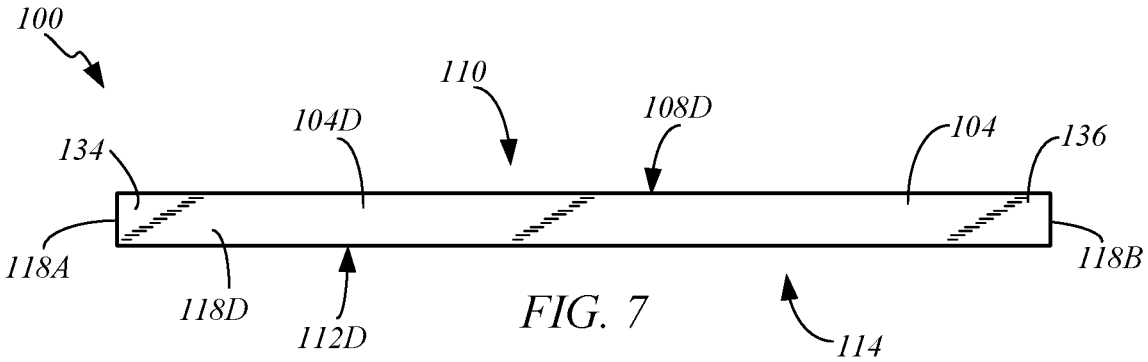
FIG. 7 is a right side view of the canvas frame of FIG. 1, in accordance with embodiments of the present disclosure.
Figure 8:
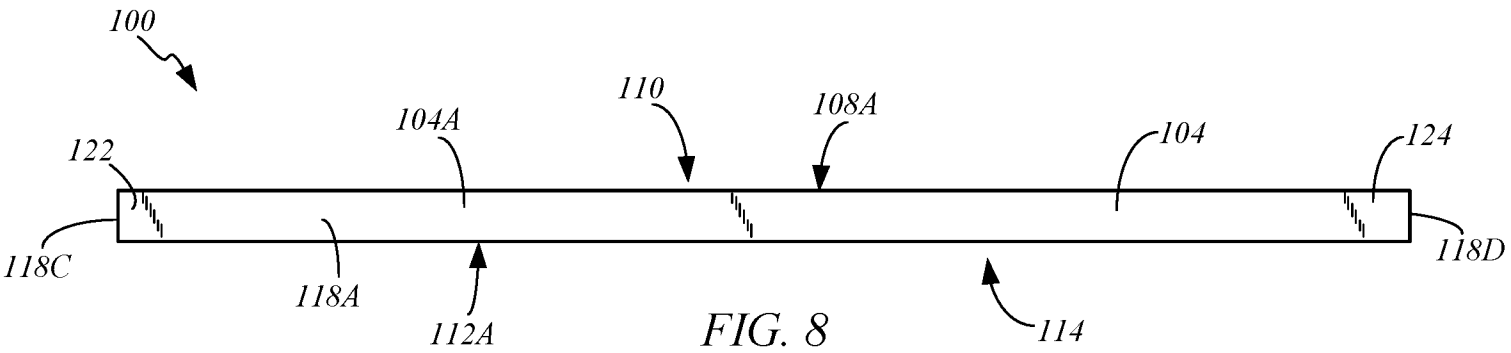
FIG. 8 is a top view of the canvas frame of FIG. 1, in accordance with embodiments of the present disclosure.
Figure 9:
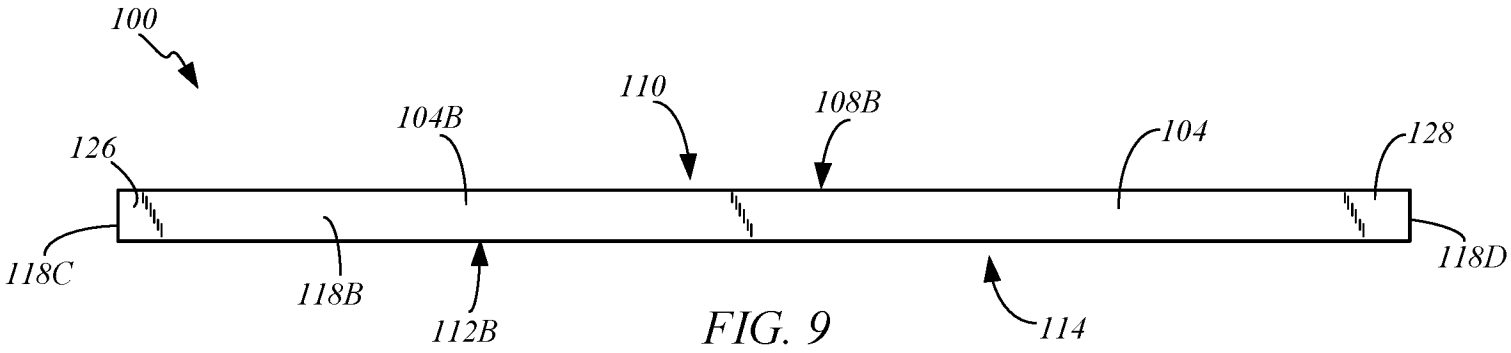
FIG. 9 is a bottom view of the canvas frame of FIG. 1, in accordance with embodiments of the present disclosure.

Embodiments of the present disclosure include a canvas frame 100 supporting a canvas 102, an example of which is shown in FIGS. 1-9. FIG. 1 is a front isometric view of the canvas frame 100, FIG. 2 is a rear isometric view of the canvas frame 100, and FIG. 3 is a front view of the canvas frame 100, FIG. 4 is a rear view of the canvas frame 100, FIG. 5 is a front view of the canvas frame 100 without the canvas 102, FIG. 6 is a left side view of the canvas frame 100, FIG. 7 is a right side view of the canvas frame 100, FIG. 8 is a top view of the canvas frame 100, and FIG. 9 is a bottom view of the canvas frame 100, in accordance with embodiments of the present disclosure.

The canvas frame 100 includes a rigid outer frame 104 that supports the canvas 102, and surrounds an interior 106. The outer frame 104 may be formed of wood or another suitable material, and may take on various shapes, such as rectangular, oval, round, or another desired shape. In the illustrated example, the outer frame 104 is rectangular and includes a front surface 108 facing a front side 110 of the canvas 102 and the canvas frame 100, and a back surface 112 facing a back side 114 of the canvas 102 and the canvas frame 100. For large outer frames 104, bracing members may extend across the interior 106 on the back side 114 to increase the rigidity of the frame 104, and maintain its shape.

The front surface 108 and the back surface 112 of the frame 104 may each extend substantially parallel to a plane 116, as illustrated in FIG. 6, or the surfaces 108 and 112 may be angled relative to the plane 116. The front surface 108 may include an ornamental profile, such as one found in conventional art frames.

The outer frame 104 includes an exterior wall 118 that extends between the front and back surfaces 108 and 112, and surrounds the outer frame 104 and the interior 106. In some embodiments, the exterior wall 118 may extend substantially perpendicularly to the front and back surfaces 108 and 112, as illustrated in FIGS. 1, 2 and 6-9. Alternatively, the exterior wall 118 may be oriented at a different angle. The exterior wall 118 may also include an ornamental profile.

The outer frame 104 also includes an interior wall 120 that surrounds the interior 106 and the canvas 102, as shown in FIGS. 1, 3 and 5. In some embodiments, the interior wall 120 extends between and generally perpendicularly to the front and back surfaces 108 and 112, as best shown in the side cross-sectional view of FIG. 10, which is taken generally along line 10-10 of FIG. 3.

In one example, the outer frame 104 is substantially rectangular, and includes a top frame member 104A, a bottom frame member 104B, and a pair of side frame members 104C and 104D, as shown in FIGS. 1-9. The top frame member 104A has opposing ends 122 and 124, an interior surface 120A, an exterior surface 118A, a front surface 108A and a back surface 112A. The bottom frame member has opposing ends 126 and 128, an interior surface 120B, an exterior surface 118B, a front surface 108B and a back surface 112B. The side frame member 104C has opposing ends 130 and 132, an interior surface 120C, an exterior surface 118C, a front surface 108C and a back surface 112C. The side frame member 104D has opposing ends 134 and 136, an interior surface 120D, an exterior surface 118D, a front surface 108D and a back surface 112D. The front surfaces 108A-D of the frame members 104A-D form the front surface 108 of the outer frame 104, the back faces 112A-D of the frame members 104A-D form the back surface 112 of the outer frame 104, and the interior surfaces 120A-D of the frame members 104A-D form the interior wall 120 of the outer frame 104.

The outer frame 104 may be assembled by connecting the ends 130 and 134 of the side frame members 104C and 104D to the end 122 and 124 of the top frame member 104A, and the ends 132 and 136 of the side frame members 104C and 104D to the ends 126 and 128 of the bottom frame member 104B, as shown in FIG. 1. The connections between the various ends of the frame members 104A-D may be formed using any suitable technique, such as using conventional joints (miter joint, splinted miter joint, keyed miter joint, overlapping joint, mortise-and-tenon joint, etc.) along with a suitable fastener (screws, adhesive, dowels, etc.).

Figure 10:
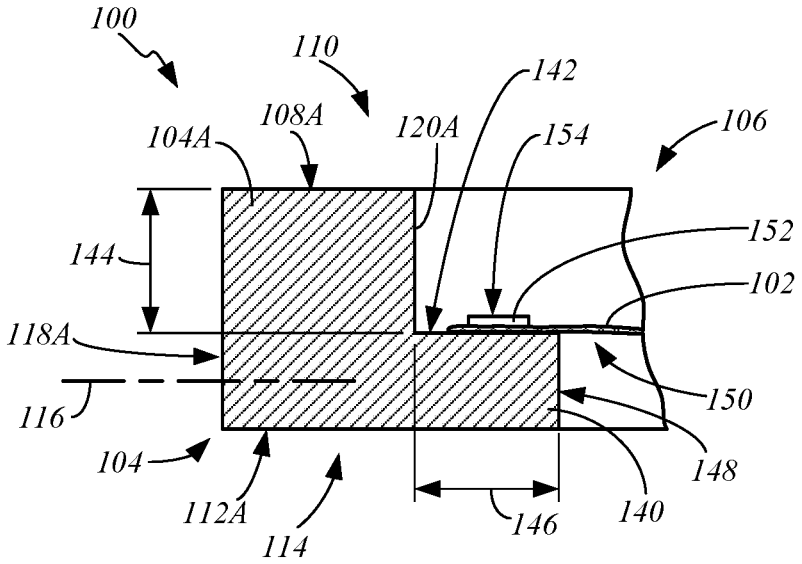
FIG. 10 is a side cross-sectional view of the canvas frame of FIG. 3, taken generally along line 10-10, in accordance with embodiments of the present disclosure.

In some embodiments, the canvas frame 100 includes a shoulder portion 140 that extends from the outer frame 104, such as from the interior wall 120, into the interior 106, as shown in FIGS. 5 and 10. The shoulder portion 140 may be formed integral with the outer frame 104, such as integral to the frame members 104A-D. Alternatively, the shoulder portion 140 may be formed separately from the frame 104, and attached to the frame 104, such as to the interior wall 120 or to a shoulder extending from the interior wall similar to the shoulder portion shown in FIG. 10.

The shoulder portion 140 includes a front surface 142 facing the front side 110 that is recessed from the front surface 108 of the outer frame 104, as shown in FIG. 10. The front surface may be recessed a distance 144 from the front surface 108 of the outer frame 104, such as about 0.25-1.5 inches, for example. The front surface 142 may have a width 146 of about 0.5-3.0 inches, for example. In some embodiments, the front surface 142 is substantially (e.g., +/−5 degrees) parallel to the plane 116.

In some embodiments, the shoulder portion 140 generally conforms to the shape of the interior wall 120. Thus, as shown in the example of FIG. 5, the interior wall and the shoulder portion may each be rectangular.

In some embodiments, when the canvas 102 is laid flat and not stretched, the canvas 102 has a shape that generally corresponds to the dimensions of an interior edge 148 (FIG. 5) of the shoulder portion 140 or slightly larger (e.g., 0.5-1.0 inch), but smaller than the interior dimensions of the interior wall 120 of the outer frame 104. The canvas 102 may comprise a conventional canvas material used for painting. However, it is understood that other materials that are conventionally attached to a frame for forming a paintable surface may also be used, such as linen and faux leather, for example. Thus, as used herein, the term "canvas" describes a material used to form a paintable surface, such as a canvas material, linen, faux leather, or similar materials. The front side 110 (FIG. 1) and/or the back side 114 (FIG. 2) of the canvas 102 may include a primer, or a primer may be applied to the front and/or back side of the canvas 102 after the canvas frame 104 is assembled.

Figure 11:
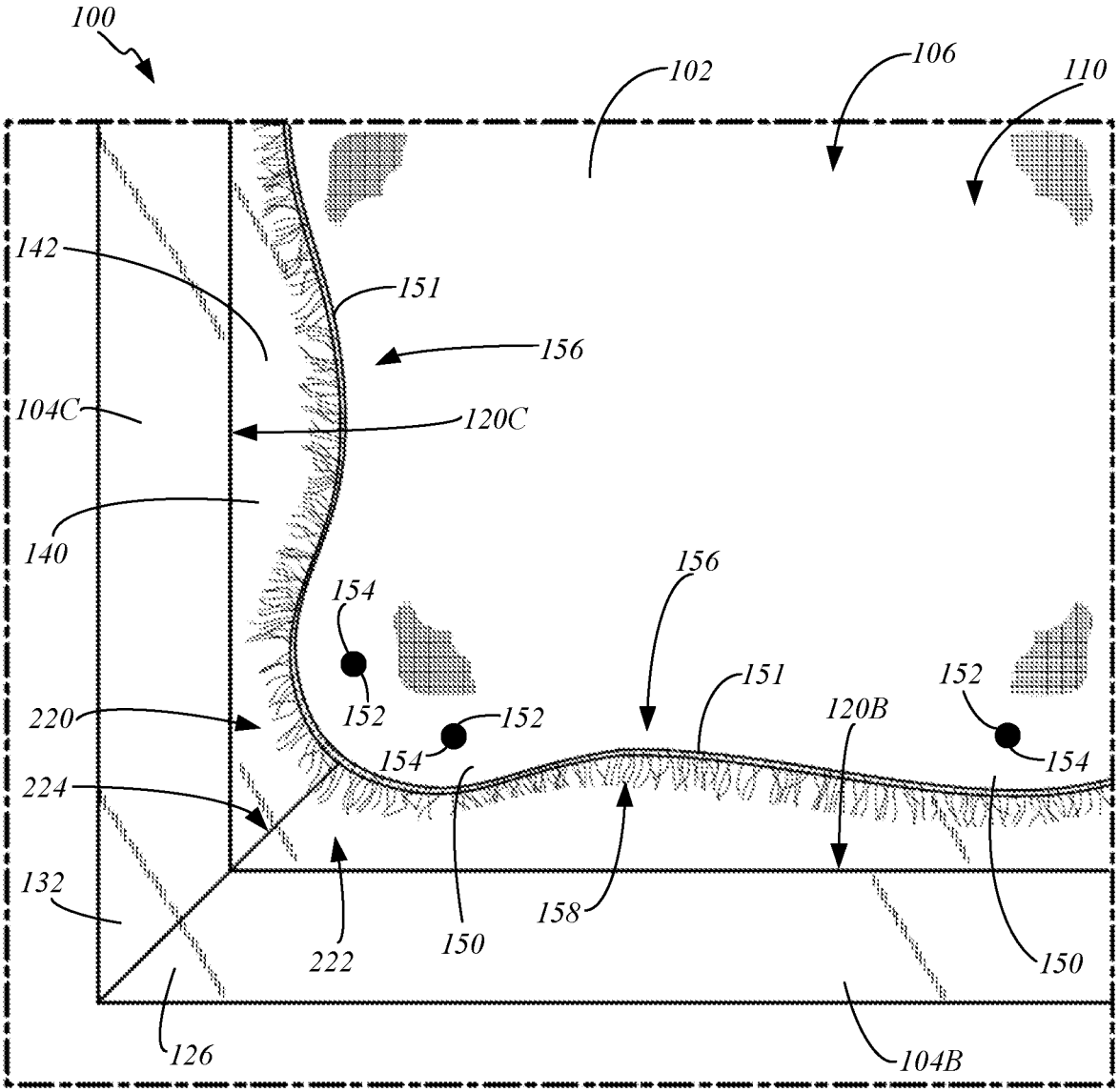
FIG. 11 is a magnified view of the portion of FIG. 3 contained in box 11, in accordance with embodiments of the present disclosure.

In some embodiments, the canvas 102 is stretched across the interior 106, and a peripheral edge portion 150 of the canvas 102 is attached to the front surface 142 of the shoulder portion 140 using a plurality of fasteners 152, such as shown in FIG. 3 and FIG. 11, which is a magnified view of the portion of FIG. 3 contained in box 11 illustrating various embodiments of the canvas frame 100. In one embodiment, the peripheral edge portion 150 extends about 0.5-2.0 inches from the outer edge 151 of the canvas 102. The fasteners 152 may include canvas or furniture tacks (shown), staples, and/or other suitable fasteners. Thus, the canvas 102 is held by the shoulder portion 140 and the outer frame 104 in tension across the interior 106 to provide a flat (e.g., substantially parallel to plane 116) and stable surface for an artist to paint an image, such as indicated by the image 153 on the front side 110 of the canvas 102 shown in phantom lines in FIG. 1.

In one embodiment, each of the plurality of fasteners includes an exposed surface 154 that is positioned over the canvas 102 and is viewable from the front side 110, as shown in FIGS. 3, 10 and 11. As used herein, the term "exposed surface" means that the surface 154 is viewable from an observer on the front side 110 of the canvas 102. When the fasteners are tacks, the exposed surface includes the top of the head of the tack, as illustrated in FIGS. 3 and 11.

In some embodiments, a coating of a primer is applied to the front side 110 of the canvas 102 and/or the back side 114 of the canvas 102, after the canvas 102 is attached to the shoulder portion 140 by the plurality of fasteners 152, and allowed to dry. The drying of the applied primer tends to contract the canvas 102, and increase the tension of the canvas 102 between the fasteners 152.

In some embodiments, due to the tension within the canvas 102 between the fasteners, the peripheral edge portion 150 varies in distance from the closest interior wall 120, as shown in FIG. 3. That is, the fasteners 152 hold the peripheral edge portion 150 in relatively close proximity to the nearest interior wall 120, while scalloped portions 156 of the peripheral edge portion 150 between adjacent fasteners 152 sag toward the interior 106, forming a wavy contour.

The outer edge 151 of the canvas 102 may take on various forms. In some embodiments, the outer edge 151 may be formed by folding or hemming the canvas 102. The outer edge may also be cut to form a smooth or jagged outer edge 151.

In one embodiment, the outer edge 151 of the canvas is frayed, as shown in FIG. 11. The frayed outer edge 151 includes strands 158 (e.g., small separate portions or fibers) of the canvas 102 that extend along the front surface 142 of the shoulder portion 140 toward the interior wall 120 of the outer frame 104. The frayed outer edge 151 may be formed using any suitable technique, such as by making a plurality of cuts in the peripheral outer portion 150 at an angle that is oblique to the outer edge 151, removing fibers at the outer edge 151 extending approximately parallel to the outer edge 151, while fibers extending obliquely to the outer edge 151 remain in place, tearing a portion of the peripheral edge portion 150, or using another suitable technique.

Figure 12:
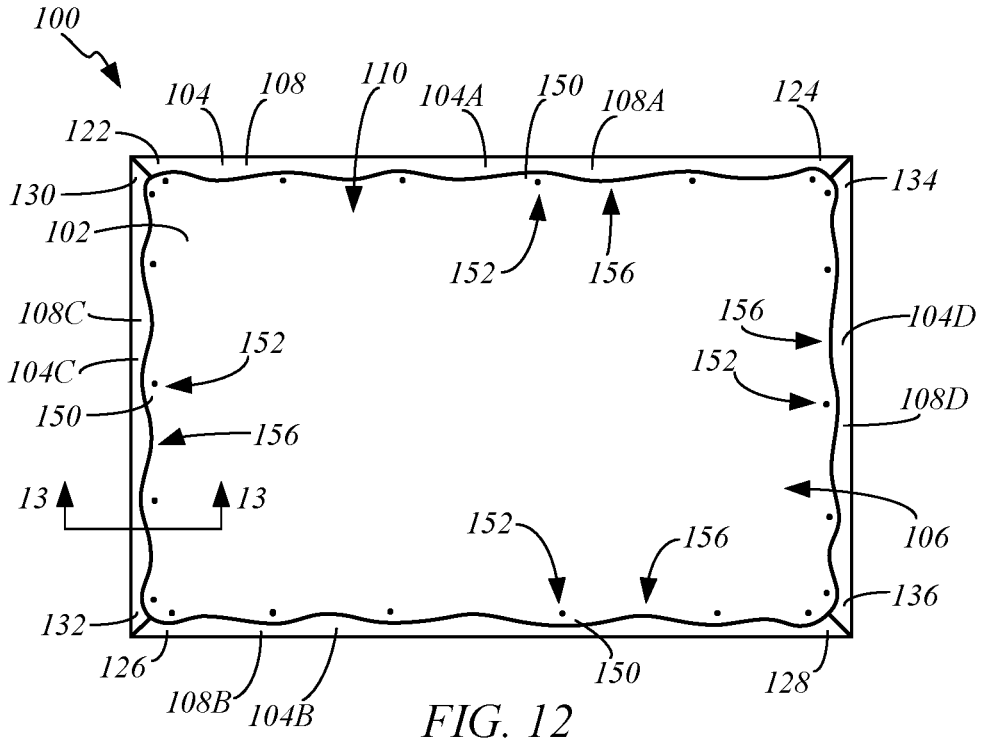
FIG. 12 is a front view of a canvas frame, in accordance with embodiments of the present disclosure.
Figure 13:
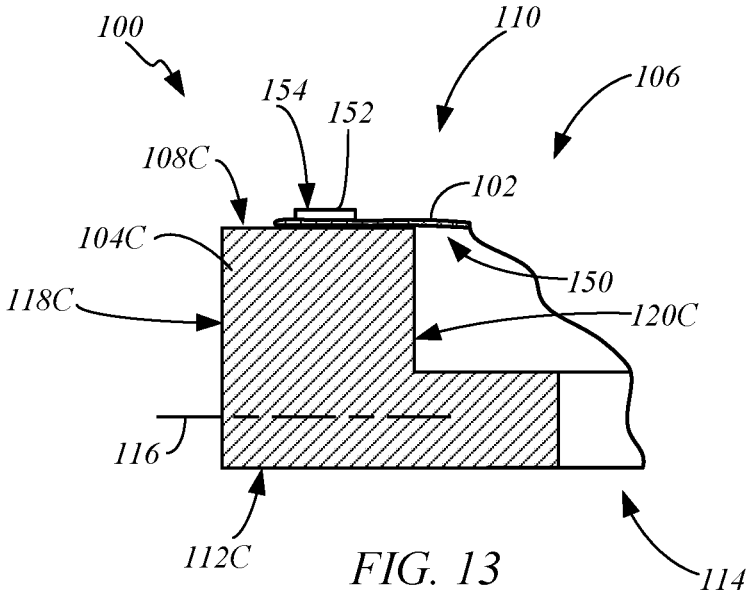
FIG. 13 is side cross-sectional view of the canvas frame of FIG. 3, taken generally along line 13-13, in accordance with embodiments of the present disclosure.

In another embodiment of the canvas frame 100, the canvas 102 is attached to the front face 108 of the outer frame 104 using the fasteners 152, as illustrated in FIGS. 12 and 13. FIG. 12 is a front view of the canvas frame 102 and FIG. 13 is a cross-sectional view of the canvas frame 102 taken along line 13-13 of FIG. 12. The shoulder portion 140 may be eliminated from this embodiment.

Figure 14:
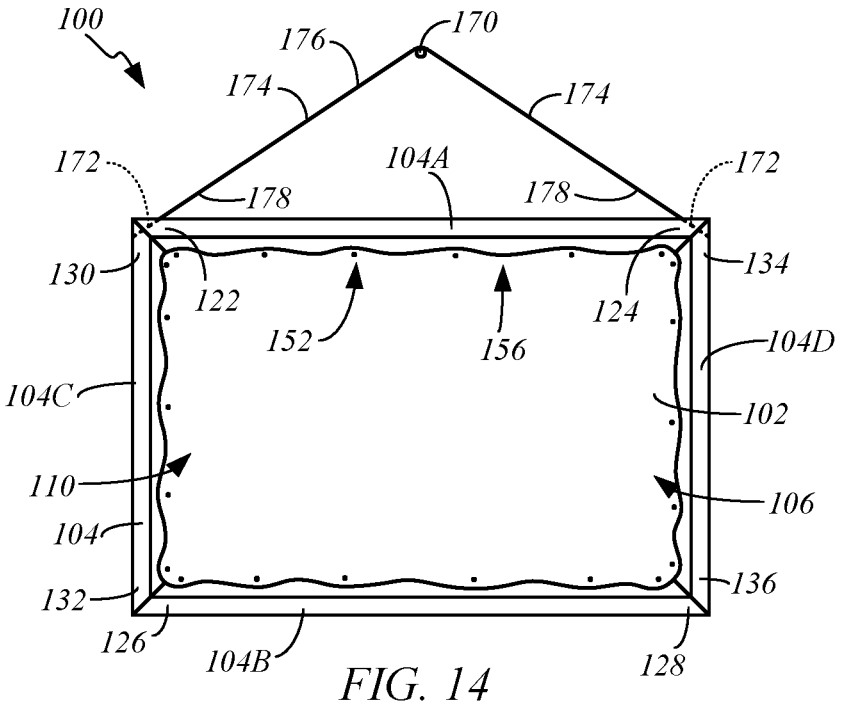
FIG. 14 is a simplified front view illustrating a canvas frame, in accordance with embodiments of the present disclosure.
Figure 15:
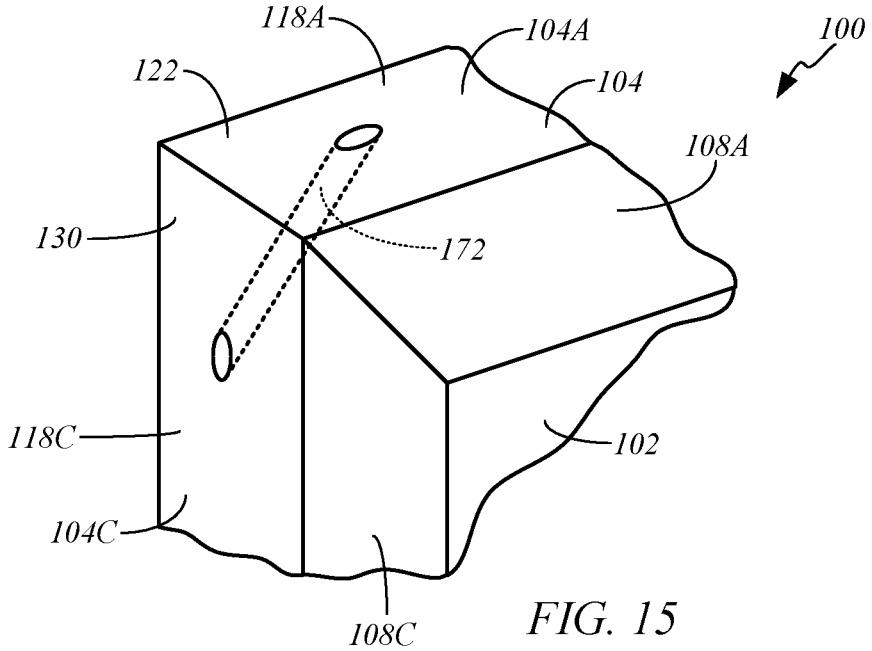
FIG. 15 is a partial isometric view of a corner of the canvas frame of FIG. 14, in accordance with embodiments of the present disclosure.

Some embodiments of the canvas frame 102 are used to facilitate hanging the canvas frame 110 from a structure, such as a peg 170 attached to a wall, for display, as shown in the simplified front view of FIG. 14. In one embodiment, a hole 172 is formed at each end 122 and 124 of the top frame member 104A that extends through the top frame member 104A and the adjoining side frame member 104C and 104D, as shown in FIG. 14 and FIG. 15, which is a partial view of the canvas frame 100 at the junction of the end 122 of the top frame member 104A and the end 130 of the left side frame member 104C.

In one embodiment, cables 174 (one or more) of a wire frame hanger 176 extend through the holes 172 and their ends 178 are secured to the outer frame 104. The wire hanger 176 may then be attached to a structure, such as a wall, to hang the canvas frame in a conventional manner, such as illustrated in FIG. 14. While a single cable wire hanger 176 is shown in FIG. 14, it is understood that cables of two separate wire hangers may also be used to hang the canvas frame. For example, the cables of separate wire hangers may each be attached to one end of the canvas frame, while the other end of each cable is secured to a structure, to allow the cables to extend vertically from the canvas frame.

Figure 16:
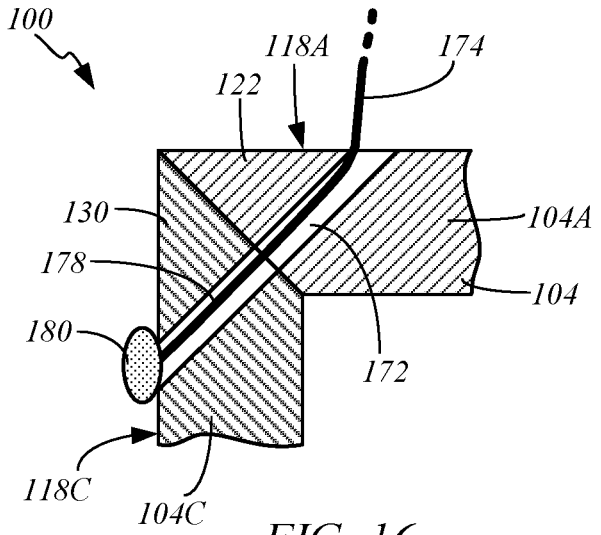
FIGS. 16 and 17 are cross-sectional views of the corner of FIG. 15 illustrating different techniques for securing a cable to the canvas frame, in accordance with embodiments of the present disclosure.
Figure 17:
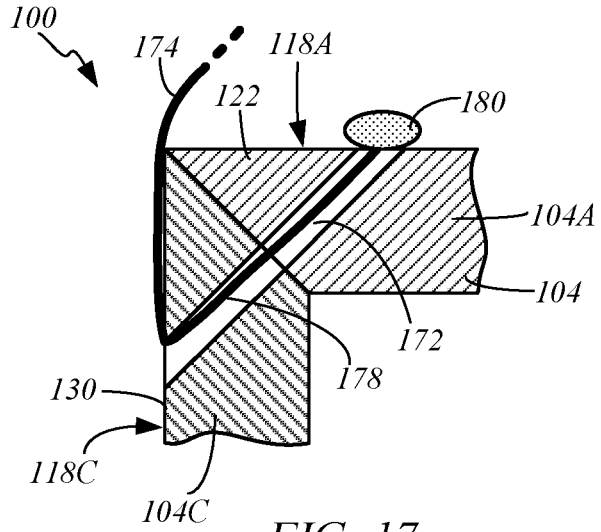

The ends 178 of the cables 174 may be secured to the outer frame 104 using various fastening techniques. FIGS. 16 and 17 are cross-sectional views of the end 122 of the top frame member 104A and the end 130 of the left frame member 104C illustrating one technique for fastening the cable end 178 to the outer frame 104, in accordance with embodiments of the present disclosure. In one embodiment, a stop 180 is secured to a distal end of the cable either before or after the cable end 178 is fed through the hole 172. In one embodiment, the distal end 178 of the cable 174 extends through the side frame member 104C, and the stop 180 engages the side frame member 104C to prevent the cable end 178 from traveling back through the hole 172, as shown in FIG. 16. Alternatively, the distal end 178 of the cable 174 may extend through the top frame member 104A, and the stop 180 engages the top frame member 104A to prevent the cable end 178 from traveling back through the hole 172, as shown in FIG. 17. Thus, the stop 180 prevents the cable 174 from passing through the hole in at least one direction, to provide the necessary attachment of the cable 174 to the outer frame 104. The techniques shown in FIGS. 16 and 17 may also applied to the other cable 174 or cable end 178 located at the end 124 of the top frame member 104A.

Figure 18:
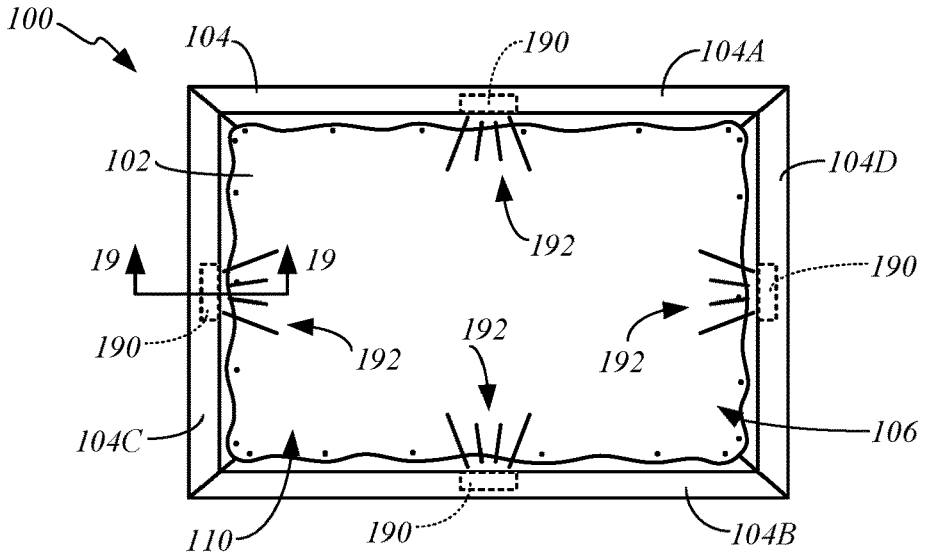
FIG. 18 is a simplified front view of a canvas frame including light sources, in accordance with embodiments of the present disclosure.
Figure 19:
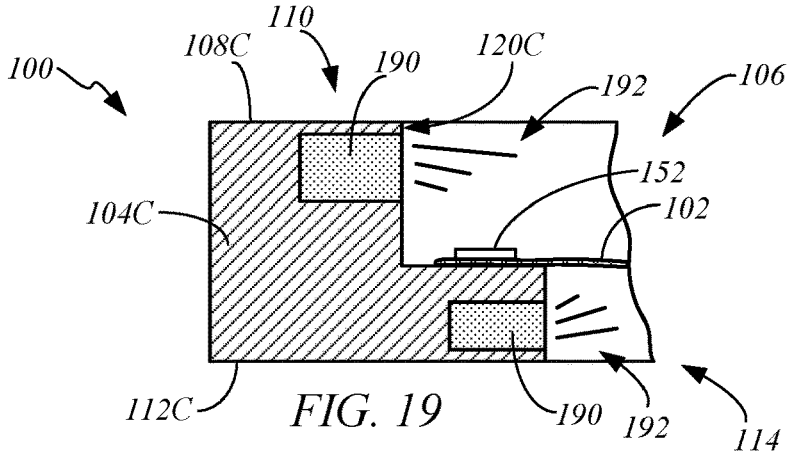
FIG. 19 is a simplified cross-sectional view of the canvas frame of FIG. 18 taken generally along line 19-19, in accordance with embodiments of the present disclosure.

In some embodiments, the canvas frame 100 includes one or more light sources 190, such as light emitting diodes (LED's) or another suitable light source, that are supported by the outer frame 104 and/or the shoulder portion 140, and are configured to direct light 192 toward the canvas 102, as indicated in the simplified front view of FIG. 18, and FIG. 19, which is a simplified cross-sectional view taken along line 19-19 of FIG. 18. In one embodiment, the light sources 190 are distributed around the interior 106 to facilitate illuminating the canvas 102 in a substantially uniform manner. Thus, the canvas frame 100 may include one or more light sources 190 attached to the top frame member 104A, the bottom frame member 104B, and/or the side frame members 104C and 104D.

Some of the light sources 190 may be embedded in the interior wall 120, and the discharged light 192 is delivered to the front side 110 of the canvas 102 or the canvas frame 100, as shown in FIG. 19. Alternatively, or in addition, the canvas frame 100 may include light sources 190 that are attached to the shoulder portion 140 and are configured to discharge light 192 to the back side 114 of the canvas 102 or the canvas frame 100, as shown in FIG. 19.

Figure 20:
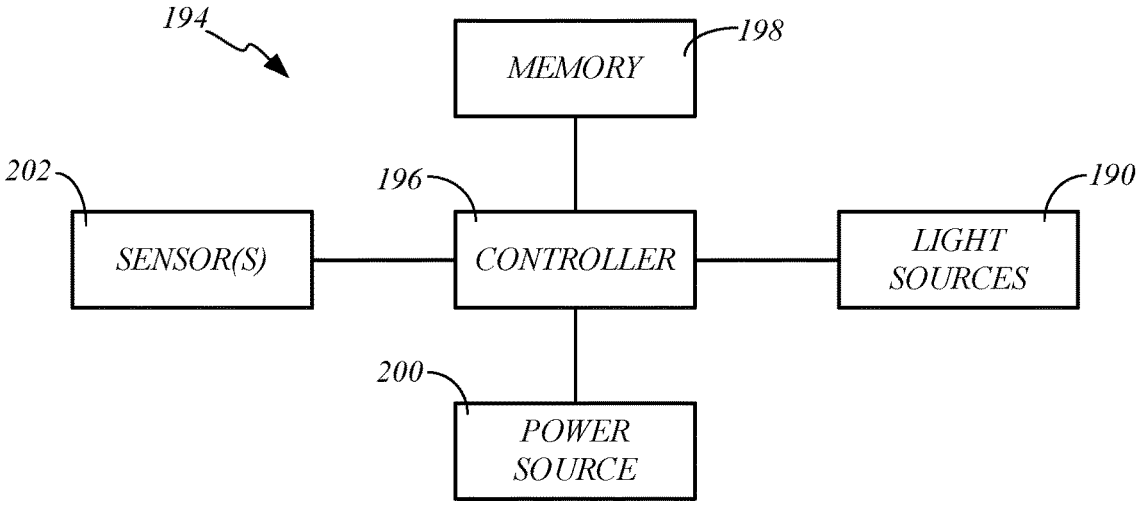
FIG. 20 is a schematic diagram of a control system, in accordance with embodiments of the present disclosure.

FIG. 20 is a schematic diagram of an example of a control system 194 for the light sources 190. In one embodiment, the system 194 includes a controller 196, which represents one or more processors that control components of the system 194 to perform one or more functions described herein in response to the execution of instructions, which may be stored in memory 198, which may be local to the system 194 or remote from the system 194. Any suitable patent subject matter eligible computer readable media or memory 198 may be utilized including, for example, hard disks, CD-ROMs, optical storage devices, or magnetic storage devices. Such computer readable media or memory 198 do not include transitory waves or signals.

In some embodiments, the one or more processors of the controller 196 are components of one or more computer-based systems. In some embodiments, the controller 196 includes one or more control circuits, microprocessor-based engine control systems, one or more programmable hardware components, such as a field programmable gate array (FPGA), that are used to control components of the system 194 to perform one or more functions described herein.

The system 194 includes the one or more light sources 190 and a power source 200 for the light sources and/or other components of the system 194. The power source 200 may take the form of a battery and/or solar panels. The power source 200 is supported by the canvas frame 104, such as attached to or embedded in the frame 104. The controller 196 may control the power source 200 to activate and deactivate the light sources 190.

In some embodiments, the controller 196 controls an intensity of the light 192 discharged by the light sources 190, and/or a frequency (i.e., color) of the light 192 discharged from the light sources 190. This control may be applied to individual light sources 190, or to the entire group of light sources 190. As a result, the light 192 discharged from the light sources 192 may be non-uniformly applied to the canvas 102, thereby allowing portions of a painting on the canvas 102, such as the painted image 153 in FIG. 1, to be illuminated more brightly than other portions, and/or illuminated in a different color than other portions. Thus, a portion or the entirety of a painting on the front side 110 of the canvas 102 may be highlighted using one or more of the light sources 190 supported on the front side 110, or backlit using one or more of the light sources 190 supported on the back side 114.

The system 194 may include one or more sensors 202 for detecting ambient light conditions, and the controller 196 may control the intensity and/or frequency of the discharged light 192 based on the detected light conditions. For example, the controller 196 may activate the light sources 190 or dim the discharged light 192 when the ambient light is low, or deactivate the light sources 190 or brighten the discharged light 192 when the ambient light is high.

Some embodiments of the present disclosure are directed to a method of manufacturing the canvas frame 100. In one embodiment, an outer frame 104 and a shoulder portion 140 are provided, and are formed in accordance with one or more embodiments of the present disclosure. For example, the outer frame 104 may include a front surface 108 facing a front side 110, a back surface 112 facing a back side 114, and an interior wall 120 extending between the front and back surfaces 108 and 112 and surrounding an interior 106, such as discussed above and illustrated in FIGS. 1-9. The shoulder portion 140 extends from the interior wall 120 into the interior 106, and includes a front surface 142 facing the front side 112. The front surface 142 is recessed from the front surface 108 of the outer frame, as shown in FIG. 10.

In the method, a canvas 102 is attached to the front surface 142 of the shoulder portion 140 using a plurality of fasteners 152. Here, the plurality of fasteners 152 are displaced from each other around the interior 106, and are each used to attach the peripheral edge portion 150 of the canvas 102 to the shoulder portion 140, such that the canvas 102 extending over the interior 106 is in tension. In one embodiment, each of the fasteners 152 has an exposed surface 154 (e.g., tack head) that overlays the canvas 102 and is viewable from the front side 110 of the canvas frame 100, as shown in FIGS. 3, 10 and 11. Due, at least in part, to the tension in the canvas 102 between the fasteners 152, the peripheral edge portion 150 includes scalloped portions 156 between the fasteners 152 that sag away from the interior wall 120 toward the interior 106, as shown in FIGS. 3 and 11. The canvas 102 may optionally be attached to the front surface 108 of the outer frame 104 using a similar technique to form the canvas frame 100 shown in FIGS. 12 and 13.

In one example, the outer frame 104 is provided or assembled by providing a top frame member 104A having opposing ends 122 and 124, an interior surface 120A, and a front surface 108A; a bottom frame member 104B having opposing ends 126 and 128, an interior surface 120B, and a front surface 108B; a side frame member 104C having opposing ends 130 and 132, an interior surface 120C, and a front surface 108C; and a side frame member 104D having opposing ends 134 and 136, an interior surface 120D, and a front surface 108D. One of the ends of each side member is connected to one of the ends of the top frame member, and the other of the ends of each side member is connected to one of the ends of the bottom frame member, to complete the assembly of the outer frame, such as shown in FIG. 5. The front surfaces 108A-D of the frame members 104A-D form the front surface 108 of the outer frame 104, and the interior surfaces 120A-D form the interior wall 120.

An example of a method of attaching the canvas 102 to the front surface 142 of the shoulder portion 140, will be described with reference to FIGS. 21A-D, which are front views of the canvas frame 102 during various stages of assembly, in accordance with embodiments of the present disclosure. While the illustrated example is of a rectangular canvas frame 100, it is understood that the method may be used to form canvas frames of other shapes using similar techniques.

Figure 21A:
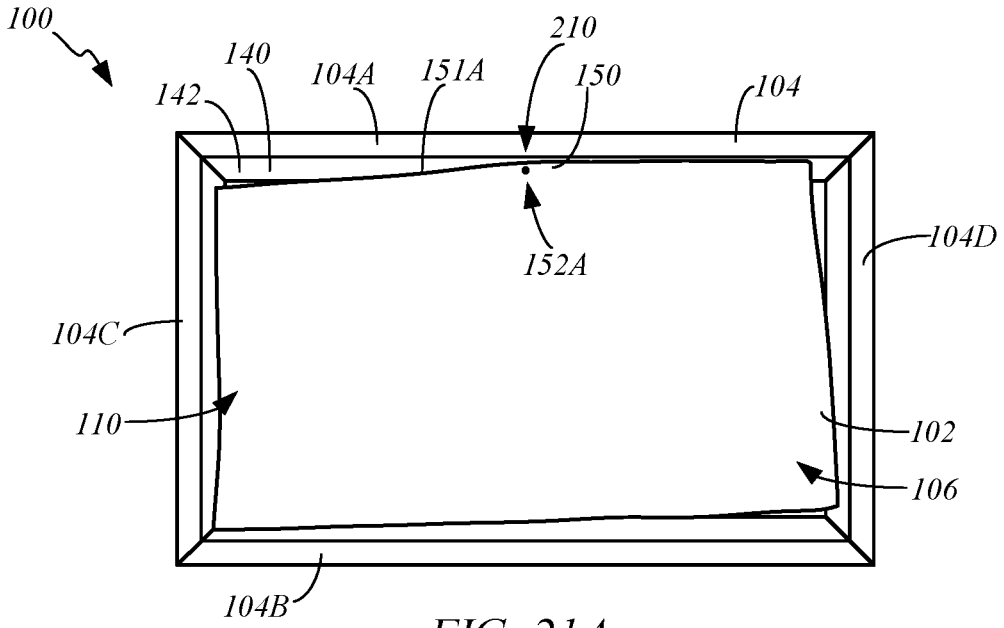
FIGS. 21A-D are simplified front views illustrating the manufacture of a canvas frame, in accordance with embodiments of the present disclosure.

In one embodiment of the method, a portion 210 of the peripheral edge portion 150 extending along a top side edge 151A of the canvas 102 is attached to the front surface 142 of the shoulder portion 140 using a fastener 152A, as indicated in FIG. 21A. The portion 210 of the peripheral edge portion 150 may be centrally located along the top side edge 151A, as shown in FIG. 21A, for example.

Figure 21B:
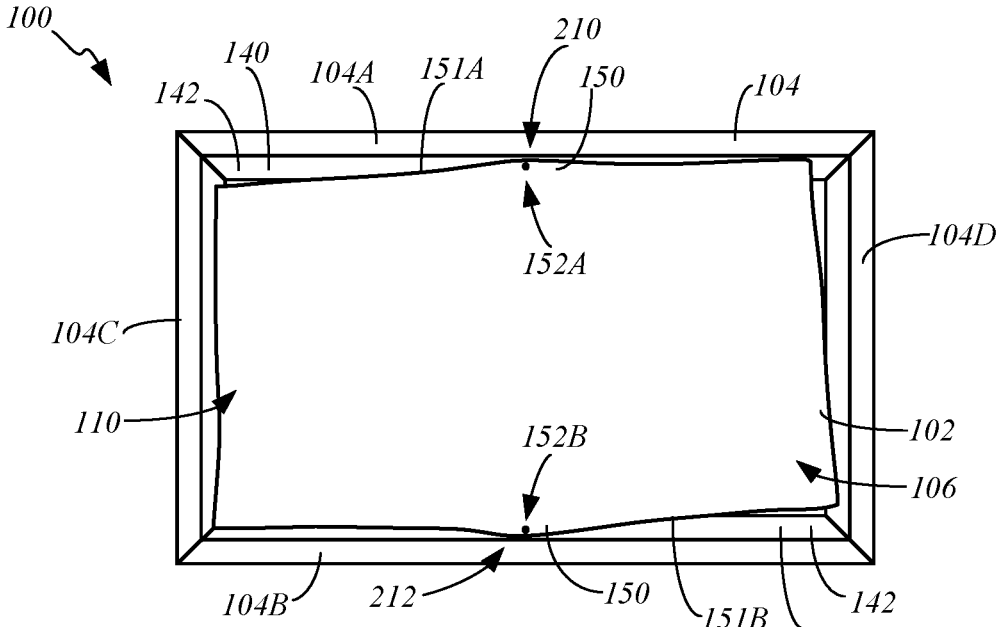

A portion 212 of the peripheral edge portion 150 extending along a bottom side edge 151B of the canvas 102 is attached to the front surface 142 of the shoulder portion 140 using a fastener 152B, as indicated in FIG. 21B. The portion 212 may be centrally located along the bottom side edge 151B, for example. The canvas 102 is tensioned between the fasteners 152A and 152B, such as by pulling the canvas 102 away from the side 151A and the fastener 152A during the attachment of the portion 212 to the front surface 142 using the fastener 152B.

Figure 21C:
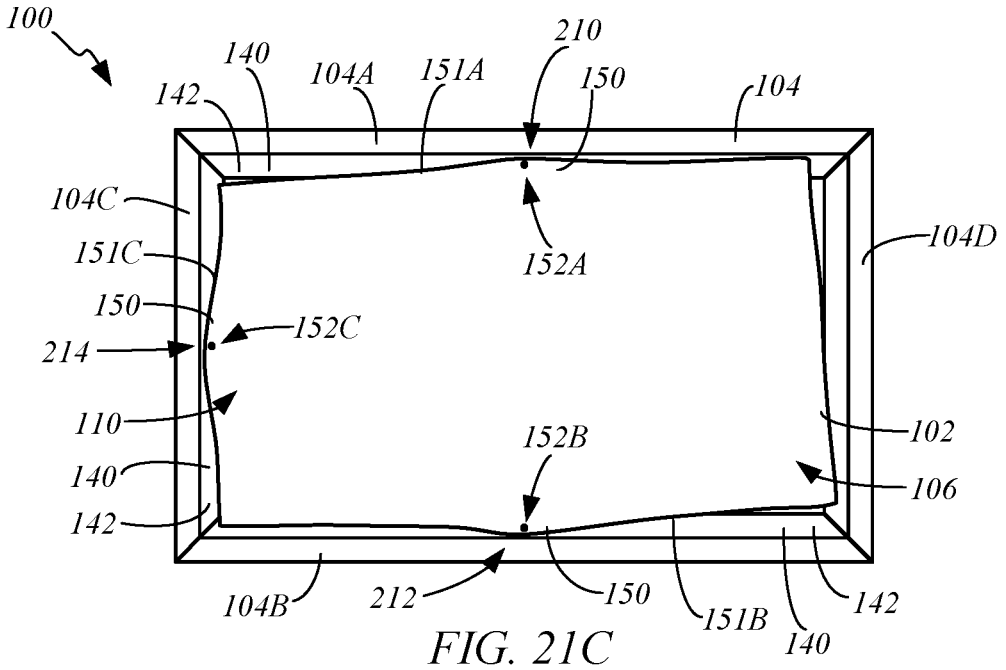
Figure 21D:
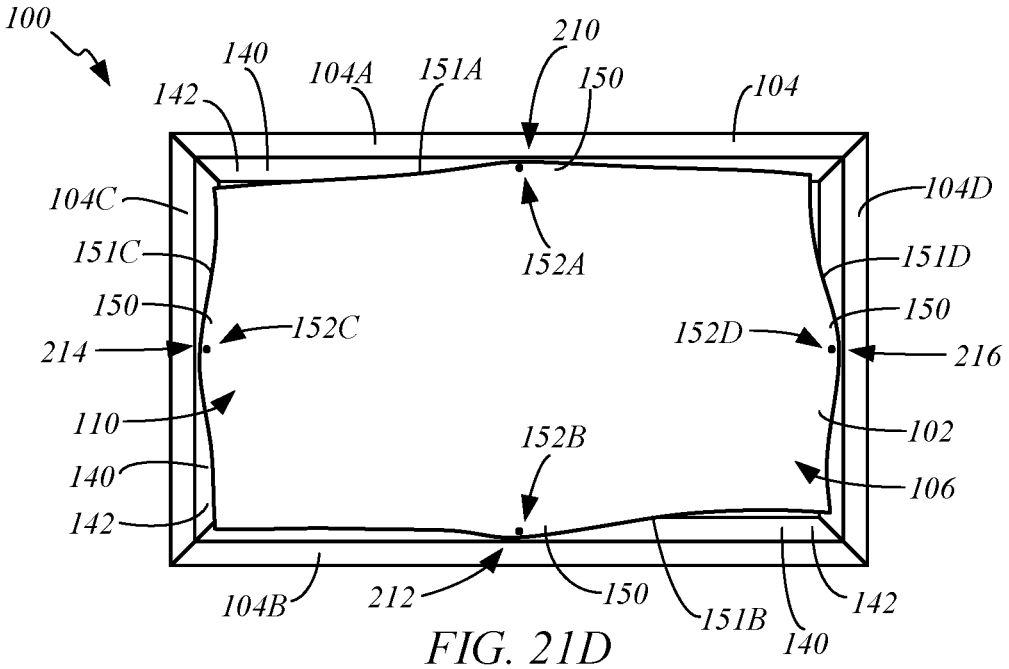

A portion 214 of the peripheral edge portion 150 extending along a left side edge 151C of the canvas 102 and between the side edges 151A and 151B is attached to the front surface 142 of the shoulder portion 140 using a fastener 152C, as indicated in FIG. 21C. The portion 214 may be centrally located along the left side edge 151C, for example.

A portion 216 of the peripheral edge portion 150 extending along a right side edge 151D of the canvas 102 and between the side edges 151A and 151B is attached to the front surface 142 of the shoulder portion 140 using a fastener 152D. The canvas 102 is tensioned between the fasteners 152C and 152D, such as by pulling the canvas 102 away from the side 151C and the fastener 152C during the attachment of the portion 216 using the fastener 152D, for example.

In one embodiment, the corners 220 (FIG. 3) of the canvas 102 are attached to the front surface 142 of the shoulder portion 140 using a similar technique as that used to attach the side edges 151A-D to the shoulder portion 140. In one example, a fastener 152 is used to attached the peripheral edge portion 150 at one of the corners 220 of the canvas to a corresponding corner 222 of the shoulder portion 140, such as shown completed in FIG. 11. In one embodiment, a pair of the fasteners 152, such as one fastener 152 on either side of the miter joint 224 between the adjoining bottom frame member 104B and side frame member 104C, as used to attach the peripheral portion 150 of the corner 220 of the canvas 102 to the corner 222 of the shoulder portion 140, as shown in FIG. 11.

After one of the corners 220 of the canvas 102 is secured to the shoulder portion 104, the peripheral portion 150 of the diagonally opposite corner 220 of the canvas 102 may be attached to the corresponding corner of the shoulder portion 140 in a similar manner while the canvas 102 is pulled in tension away from the fastened corner 220. The same process may then be conducted to attach the peripheral portions 150 of the canvas 102 of the remaining corners 220.

Additional portions of the peripheral edge portion 150 extending along the edges 151A-D may then be attached to the front surface 142 using additional fasteners 152 while tensioning the canvas 102 between the fasteners 152 in a similar manner as described above to complete the attachment of the canvas 102 to the shoulder portion 140 and the outer frame 104, such as generally shown in FIG. 3. Due to the tension in the canvas 102 between the fasteners 152, scalloped portions 156 of the peripheral edge portion 150 form between adjacent fasteners 152, as discussed above.

In some embodiments, a coating of primer is applied to the front side 110 and/or back side 114 of the canvas 102 after the canvas 102 has been attached to the shoulder portion 142 and the outer frame 104. As the primer dries, it increases the tension in the canvas 102. The increased tension enhances the scalloped portions 156 by pulling them further toward the interior 106. Alternatively, a coating of primer may be applied to the front side 110 and/or back side 114 of the canvas 102 before mounting the canvas 102 to the shoulder portion 142.

In some embodiments, holes 172 may be formed through each end 122 and 124 of the top frame member 104A, each of which extends through one of the ends 130 or 134 of the corresponding side frame members 104C and 104D, as discussed above with reference to FIGS. 14-17. Cable ends 178 of at least one wire hanger 176 are extended through the holes 172, and the cable ends 178 are prevented from being removed through their corresponding holes 172 in at least one direction. In one embodiment, stops 180 are attached to the cable ends 178 to prevent them from withdrawing through the holes 172. The canvas frame 102 may then be hung from a structure using the at least one wire hanger 176, as shown in FIG. 14.

Although the embodiments of the present disclosure have been described with reference to preferred embodiments, workers skilled in the art will recognize that changes may be made in form and detail without departing from the spirit and scope of the present disclosure.

What is claimed is:

1. A canvas frame comprising:

an outer frame including a front surface facing a front side, a back surface facing a back side, and an interior wall extending between the front and back surfaces and surrounding an interior;

a shoulder portion extending from the interior wall into the interior and including a front surface facing the front side that is recessed from the front surface of the outer frame; and a canvas stretched across the interior and attached to the front surface of the shoulder portion using a plurality of fasteners, each fastener having an exposed portion, wherein a peripheral edge portion of the canvas includes scalloped portions between adjacent fasteners where the canvas sags toward the interior due to tension in the canvas between opposing fasteners.

2. The canvas frame of claim 1, wherein the outer frame comprises:

a top frame member having opposing ends, an interior surface, and a front surface;

a bottom frame member having opposing ends, an interior surface, and a front surface; and a pair of side frame members, each side member having opposing ends, an interior surface, and a front surface, wherein:

one of the ends of each side member is connected to one of the ends of the top frame member, and the other of the ends of each side member is connected to one of the ends of the bottom frame member;

the front surfaces of the top frame member, the bottom frame member and the pair of side frame members form the front surface of the outer frame; and the interior surfaces form the interior wall.

3. The canvas frame of claim 2, wherein the interior wall of the outer frame and the shoulder portion are each rectangular.

4. The canvas frame of claim 2, wherein the peripheral edge portion of the canvas is frayed and strands of the canvas extend along the front surface of the shoulder portion toward the interior wall.

5. The canvas frame of claim 2, wherein a front surface of the canvas on the front side is coated with a primer.

6. The canvas frame of claim 2, wherein the plurality of fasteners include tacks.

7. The canvas frame of claim 2, further comprising:

a first hole extending through the top frame and a first of the pair of side frame members;

a second hole extending through the top frame and a second of the pair of side frame members; and at least one frame hanger comprising a first cable end extending through the first hole, and a second cable end extending through the second hole.

8. The canvas frame of claim 7, further comprising:

a first stop attached to the first cable end, the first stop preventing the first cable end from being removed from the first hole in one direction; and a second stop attached to the second cable end, the second stop preventing the second cable end from being removed from the second hole in one direction.

9. The canvas frame of claim 1, wherein:

the canvas includes a front surface facing the front side, and a rear surface facing the back side; and an image is formed on the rear surface, which is visible from the front side through the canvas.

10. The canvas frame of claim 1, further comprising light sources supported by the outer frame and configured to direct light toward the canvas.

11. A method of manufacturing a canvas frame comprising:

providing an outer frame including a front surface facing a front side, a back surface facing a back side, and an interior wall extending between the front and back surfaces and surrounding an interior;

providing a shoulder portion extending from the interior wall into the interior and including a front surface facing the front side that is recessed from the front surface of the outer frame; and attaching a canvas to the front surface of the shoulder portion using a plurality of fasteners, each fastener having an exposed portion that is visible from a front side of the canvas, wherein a peripheral edge portion of the canvas includes scalloped portions between adjacent fasteners where the canvas sags toward the interior due to tension in the canvas.

12. The method of claim 11, wherein attaching the canvas to the front surface of the shoulder portion comprises:

attaching a first portion of the peripheral edge portion extending along a first side edge of the canvas to the front surface of the shoulder portion using a first of the plurality of fasteners;

attaching a second portion of the peripheral edge portion extending along a second side edge of the canvas, which is opposite the first side edge, to the front surface of the shoulder portion on an opposing side of the interior from the first portion using a second of the plurality of fasteners, wherein the canvas is tensioned between the first and second fasteners;

attaching a third portion of the peripheral edge portion extending along a third side edge of the canvas to the front surface of the shoulder portion, wherein the third side edge extending between the first and second side edges;

attaching a fourth portion of the peripheral edge portion extending along a fourth side edge of the canvas to the front surface of the shoulder portion, wherein the fourth side edge on an opposing side of the canvas from the third side edge and extending between the first and second side edges, and the canvas is tensioned between the third and fourth fasteners; and attaching additional portions of the peripheral edge portion of the canvas extending along the first side edge, the second side edge, the third side edge, and the fourth side edge to the front surface of the shoulder portion using the fasteners, wherein the canvas is tensioned between opposing fasteners.

13. The method of claim 12, further comprising coating a front surface of the canvas facing the front side with a primer, and drying the primer.

14. The method of claim 13, including increasing the tension in the canvas in response to drying the primer.

15. The method of claim 11, wherein providing the outer frame comprises:

providing a top frame member having opposing ends, an interior surface, and a front surface;

providing a bottom frame member having opposing ends, an interior surface, and a front surface;

providing a pair of side frame members, each side member having opposing ends, an interior surface, and a front surface; and connecting one of the ends of each side member to one of the ends of the top frame member, and the other of the ends of each side member to one of the ends of the bottom frame member, wherein:

the front surfaces of the top frame member, the bottom frame member and the pair of side frame members form the front surface of the outer frame; and the interior surfaces form the interior wall.

16. The method of claim 15, further comprising:

forming a first hole extending through the top frame and a first of the pair of side frame members;

forming a second hole extending through the top frame a second of the pair of side frame members;

extending a first cable end of at least one frame hanger through the first hole;

extending a second cable end of the at least one frame hanger through the second hole; and preventing the first and second cable ends from being removed through the corresponding first and second holes in one direction.

17. A canvas frame comprising:

an outer frame including a front surface facing a front side, a back surface facing a back side, and an interior wall extending between the front and back surfaces and surrounding an interior; and a canvas stretched across the interior and attached to the front surface of the outer frame using a plurality of fasteners, each fastener having an exposed portion, wherein a peripheral edge portion of the canvas includes scalloped portions between adjacent fasteners where the canvas sags toward the interior due to tension in the canvas between opposing fasteners.

18. The canvas frame of claim 17, wherein the outer frame comprises:

a top frame member having opposing ends, an interior surface, and a front surface;

a bottom frame member having opposing ends, an interior surface, and a front surface; and a pair of side frame members, each side member having opposing ends, an interior surface, and a front surface, wherein:

one of the ends of each side member is connected to one of the ends of the top frame member, and the other of the ends of each side member is connected to one of the ends of the bottom frame member;

the front surfaces of the top frame member, the bottom frame member and the pair of side frame members form the front surface of the outer frame; and the interior surfaces form the interior wall.

19. The canvas frame of claim 18, wherein the peripheral edge portion of the canvas is frayed and strands of the canvas extend along the front surface of the shoulder portion toward the interior wall.

20. The canvas frame of claim 2, further comprising:

a first hole extending through the top frame and a first of the pair of side frame members;

a second hole extending through the top frame a second of the pair of side frame members; and at least one frame hanger comprising a first cable end extending through the first hole, and a second cable end extending through the second hole, wherein the first and second cables are secured to the outer frame to prevent the first and second cables from being removed from the corresponding first and second holes in at least one direction.

21. The canvas frame of claim 17, wherein a surface of the canvas includes a coating of primer.

22. The canvas frame of claim 17, wherein an outer edge of the canvas that includes the peripheral edge portion is smooth or jagged.

23. The canvas frame of claim 17, wherein an outer edge of the canvas that includes the peripheral edge portion is hemmed.

24. The canvas frame of claim 17, wherein the canvas comprises linen or faux leather.

* * * * *